US005947803A

United States Patent [19]

Gruner

[11] Patent Number: 5,947,803

[45] Date of Patent: Sep. 7, 1999

[54] SANDER HAVING A PLANAR SURFACE CONVERTIBLE TO A RIGHT ANGULAR SURFACE

[76] Inventor: Glen A. Gruner, 4659 Christensen St., Brentwood, Calif. 94513

[21] Appl. No.: 08/929,508

[22] Filed: Sep. 15, 1997

[51] Int. Cl.[6] ..... B24B 17/00; B24B 15/00

[52] U.S. Cl. ..... 451/354; 451/495; 451/524

[58] Field of Search ..... 15/49.1, 229.13; 451/344, 354, 490, 495, 523, 524, 525

[56] References Cited

U.S. PATENT DOCUMENTS 2,402,069 6/1946 Minnick et al. .
3,123,947 3/1964 Rawley .
3,279,130 10/1966 Nelson .
3,879,904 4/1975 Hafner .
4,663,795 5/1987 Helling et al. .
5,402,559 4/1995 Allison et al. ..... 451/524 X
5,700,187 12/1997 Balbi ..... 451/495
5,706,835 1/1998 Salvino ..... 132/75.6

*Primary Examiner*—Timothy V. Eley
*Attorney, Agent, or Firm*—Linval B. Castle

[57] ABSTRACT

A hand operateable sander having a flat sanding block for sanding flat surfaces and which automatically pivots into a "V" shape for sanding outside corners and bullnose surfaces.

7 Claims, 2 Drawing Sheets

SANDER HAVING A PLANAR SURFACE CONVERTIBLE TO A RIGHT ANGULAR SURFACE

This invention relates to hand tools and in particular to a drywall sander with a flat sanding surface that automatically converts into a bullnose sander for the finishing sanding of walls, ceilings and bullnose surfaces.

SUMMARY OF THE INVENTION

One of the final steps in building construction is the installation of interior walls which is usually accomplished by installing large wall panels between the floor and ceiling. These panels are generally a paper covered plaster sheet of standard width and are known in the trade as drywall. The wall or ceiling is formed by abutting these drywall panels and nailing them to the studs or joists with the nails slightly countersunk. Then the countersunk nail heads and the abutting junctures of the panels are taped with a heavy paper tape cemented with a drywall cement that eventually dries with the appearance and texture of plaster.

Before a wall and ceiling is painted, it must be sanded smooth to remove the irregularities, such as the roughness of dried drywall cement. For flat surfaced walls, a flat sanding block is adequate, and for high ceilings an extension handle is needed such as described by Helling in Pat. No. 4,663,796. But for outside corners and bullnose surfaces, it was necessary for the finish sander to hand sand or improvise a special sander. The sander described herein provides a flat block for sanding flat surfaces and automatically bands to sand bullnose surfaces.

Briefly described, the sander of the invention is comprised of a flexible rubberlike sanding pad to which appropriate sand paper is attached. The sanding pad is secured to two elongated, parallel members which normally provide a flat surface but which can be pivoted inward to form a "V" shaped sanding block for sanding outside corners or bullnose surfaces. The two parallel members are pivoted to a lateral shaft to which a handle is attached.

BRIEF DESCRIPTION OF THE DRAWINGS

In the drawings which illustrate the preferred embodiment of the invention.

DETAILED DESCRIPTION OF THE PREFERRED EMBODIMENT

Figure 1:
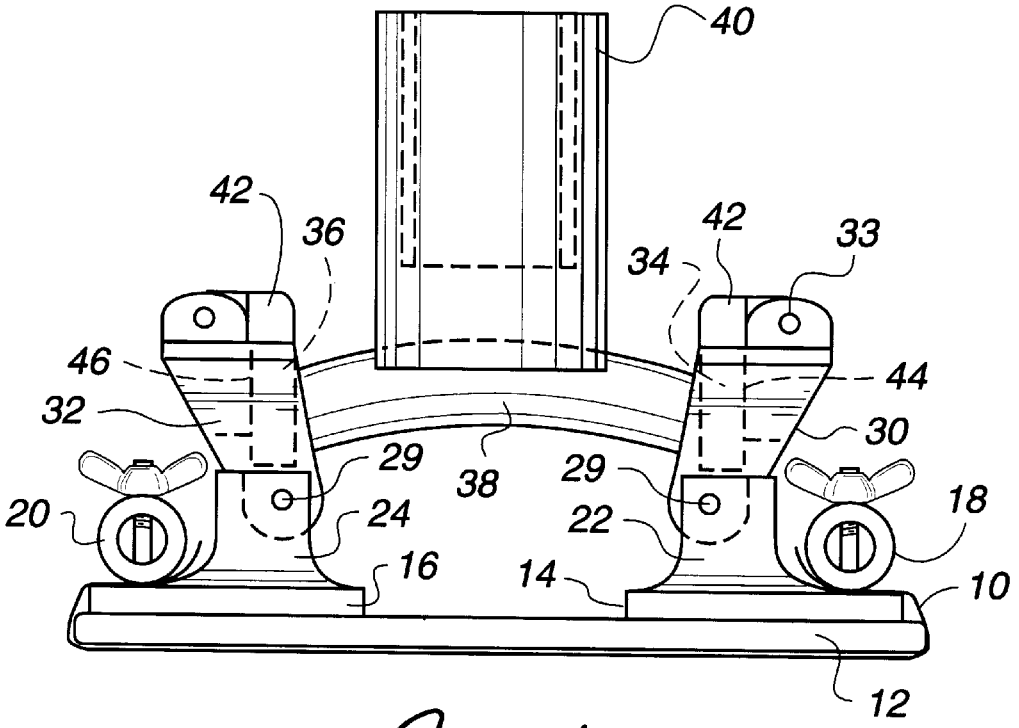
FIG. 1 is a front elevational view of the drywall sander of the invention.

The sander of the invention may be used on an extension handle as a flat sanding block for sanding flat surfaces, or folder into an inverted "V" for sanding outside corners or bullnose surfaces. As shown in FIG. 1 a sheet of sanding material, such as sandpaper 10, covers the bottom surface of a substantially square, flat, flexible, rubberlike pad 12, about one-quarter inch thick, that is cemented to the bottom surfaces of two spaced, parallel, elongated elements 14, 16. The sandpaper 10 is secured by clamps 18, 20 clamping the sandpaper 10 to the top surfaces of elongate elements 14, 16. The sandpaper clamps 18, 20 have been omitted from the drawings of FIGS. 2 and 3 for clarity.

Figure 2:
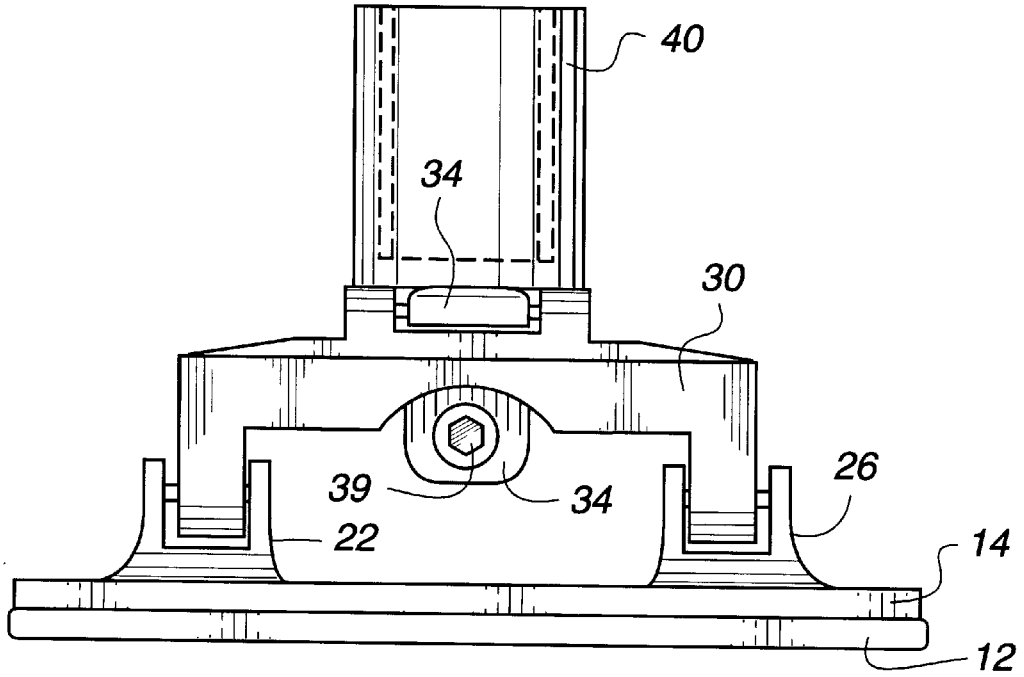
FIG. 2 is a side elevational view of the sander.

The elongated elements 14, 16 are formed of a rigid metal about one eighth inch thick and have flat bottom surfaces, a length substantially equal to the overall length of the sander, as shown in FIG. 2, and each has a width substantially equal to one-third the overall width of the sander, as seen in FIG. 1. The elongated elements 14, 16 are parallel and separated by a space equal to one-third the sander width.

Figure 3:
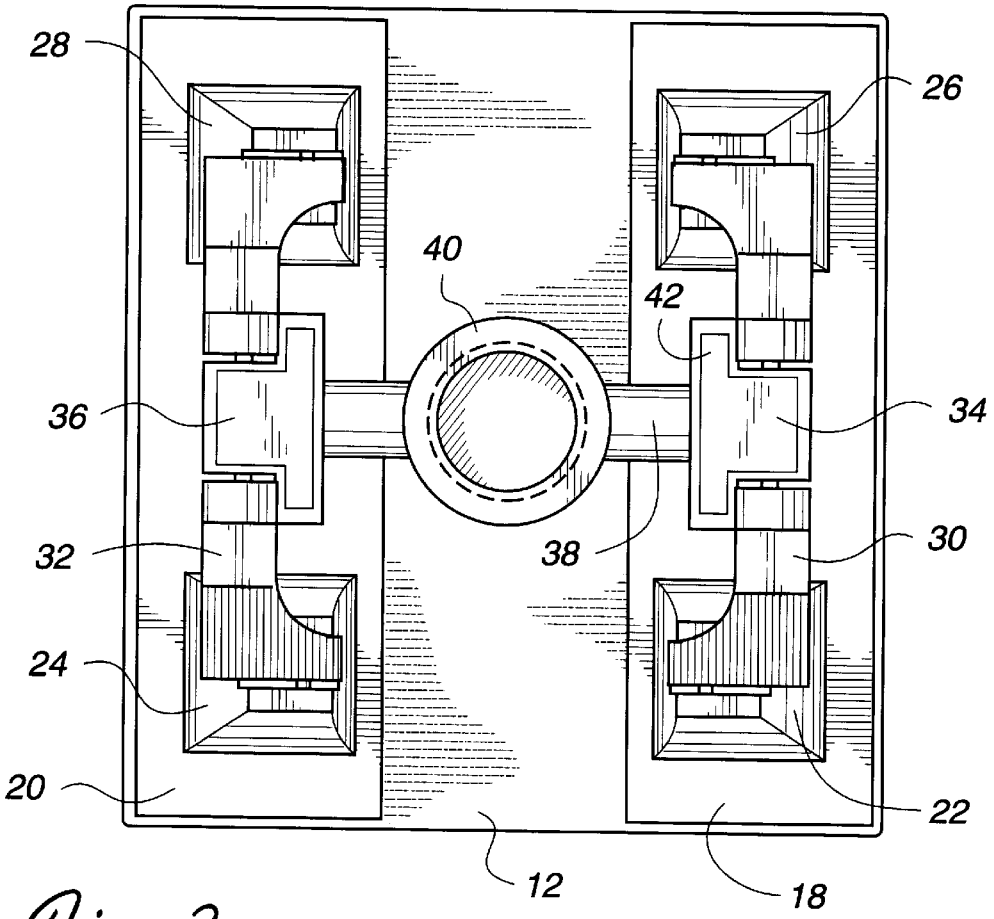
FIG. 3 is a plan view thereof.

On the top surface near each end of each of the two elongated elements 14, 16 are one inch risers 22, 24, 26, 28 which contain parallel pivot pins 29 which pivotally connect the members 14, 16 to frames 30 and 32. Thus, the frame 30 is pivotally coupled to the elongated element 14 by coaxial pivot pins extending through the risers 22 and 26, as shown in FIG. 2, and similarly, the frame 32 is pivotally coupled to the element 16 by coaxial pivot pins through the risers 24 and 28, as best shown in FIG. 3.

Figure 4:
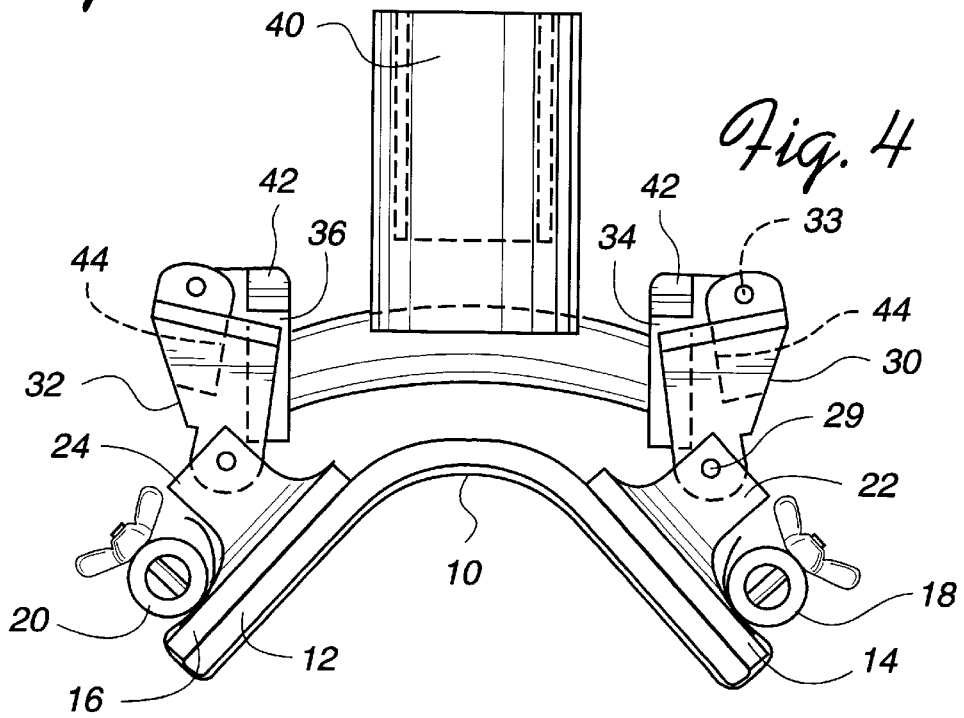
FIG. 4 is a front elevational view thereof, illustrated in its bullnose sander form.

The two frames 30, 32 each contain second parallel pivot pins 33 near the frame centers, and also have limiting features which will be subsequently described. The second pivot pins 33 pivotally connect the center portion of the two frames 30, 32 to identical shaft terminal blocks 34, 36 at the ends of a central lateral shaft 38 which has a centrally positioned socket 40 for the attachment of a short handle or an extension handle. Shaft 38 may be a straight shaft but is preferably arched, as shown, to avoid any interference with the flexible pad 12 when the pad is bent as shown in FIG. 4.

The shaft terminal blocks 34, 36 are also pivotally connected to the lateral shaft 38 by bolt 39 to permit the handle socket 40 to freely swing back and forward. The terminal blocks are identical, each is rectangular in shape, as best shown in FIG. 4, with small rectangular side extensions 42 extending to the sides from the top, producing a top plan view of the terminal block to appear as a "T", as seen in FIG. 3. These extensions 42 cooperate with the top flat surface of frames 30, 32 to limit the pivotal action of the frames to a downward movement. Additionally, the flat inner surfaces 44, 46 of the frames 30, 32, which are normally in contact with the flat exterior faces of the shaft terminal blocks 34, 36, will prevent pivotal movement except the outward pivoting of the frames 30, 32 on the pivots 29, as seen in FIG. 4. Thus, the relative pivotal motion between the terminal blocks 34, 36 and the frames 30, 32 is limited to only one direction from the normal planar sander of FIG. 1.

When sanding a flat surface, the sander is pressed against the surface and the flat lower surfaces of the elements 14, 16 will be forced into the planar shape of FIG. 1. When sanding anything that causes the flat lower surfaces of elements to turn in toward each other, such as a bullnose edge a slight pressure on the handle will urge the flexible sanding pad 12 to bend as in FIG. 4. This bending toward a right angle by the pad 12 causes the pivots 29 on the risers 22, 24 and the bottom portions of the elongated frames 30, 32 to move outward. The frames are attached to the handle shaft 38 by the pivot pins 33 which couple the frames to the shaft terminal blocks 34,36.

I claim:

1. A drywall sander having a planar surface convertible to a right angular surface for sanding bullnose surfaces, said sander comprising:

a flat flexible pad for supporting a sanding medium, said pad having an approximately equal length and width;

first and second rigid members having planar surfaces attached to a first surface of said pad, each of said rigid members having longitudinal edges having a length substantially equal to the length of said flexible pad and each with a width approximately one-third the width of said pad, said members being parallel and spaced on said pad, each of said rigid members having a second surface opposite to said first surface;

first hinging means attached to the second surface of each of said rigid members, said first hinging means having parallel pivot pins on an axis parallel with the longitudinal edges of said members;

a lateral handle supporting shaft having each end axially rotatably connected to shaft blocks;

second hinging means pivotally coupled to each of said shaft blocks, said second hinging means having parallel pivot pins parallel with the pivot pins of said first hinging means;

a frame member coupled to said first hinging means of each of said rigid members and to the second hinging means on each of said shaft blocks;

whereby said rigid members may be rotated on said first hinging means so that their planar surfaces form a "V".

2. The sander claimed in claim 1 further including limiting means cooperating between said shaft blocks and said frame members for limiting the direction of rotation of said frame members around the pivot pins of said second hinging means.

3. The sander claimed in claim 2 wherein said limiting means includes the abutment of a surface of said frame member against a stationary surface of said shaft block.

4. The sander claimed in claim 1 further including clamping means on said second surface of each of said rigid members for securing a sanding medium, said sanding medium extending around said first surface.

5. The sander claimed in claim 1 wherein the pivot pins of said first hinge means are spaced above said second surface of said rigid members approximately one inch from said surface.

6. The sander claimed in claim 1 wherein said lateral shaft supports a socket for the attachment of a handle.

7. The sander claimed in claim 1 wherein said lateral shaft is arched for avoiding interference with said flexible pad.

* * * * *